US007275271B1

(12) United States Patent
Smith

(10) Patent No.: US 7,275,271 B1
(45) Date of Patent: Oct. 2, 2007

(54) TOILET EVACUATION SYSTEM

(76) Inventor: Robert I. Smith, 9200 SW. 210 Cir., Dunnellon, FL (US) 34431

( * ) Notice: Subject to any disclaimer, the term of this patent is extended or adjusted under 35 U.S.C. 154(b) by 224 days.

(21) Appl. No.: 10/711,824

(22) Filed: Oct. 7, 2004

Related U.S. Application Data

(60) Provisional application No. 60/481,477, filed on Oct. 7, 2003.

(51) Int. Cl.
*E03D 9/04* (2006.01)
*E03D 9/05* (2006.01)

(52) U.S. Cl. ..... 4/213; 4/216; 4/348; 4/351; 4/352

(58) Field of Classification Search ..... 4/213–214, 4/215–218, 347–352
See application file for complete search history.

(56) References Cited

U.S. PATENT DOCUMENTS

| | | | | | |
|---|---|---|---|---|---|
| 2,297,935 | A | * | 10/1942 | Baither | 4/213 |
| 2,985,890 | A | * | 5/1961 | Baither | 4/213 |
| 3,763,505 | A | | 10/1973 | Zimmerman | |
| 3,902,203 | A | * | 9/1975 | Poister et al. | 4/213 |
| 4,103,370 | A | | 8/1978 | Arnold | |
| 4,318,192 | A | | 3/1982 | Williams et al. | |
| 4,402,091 | A | | 9/1983 | Ellis et al. | |
| 4,864,664 | A | | 9/1989 | Higgins | |
| 5,125,119 | A | | 6/1992 | Munoz | |
| 5,231,705 | A | | 8/1993 | Ragusa | |
| 5,325,544 | A | | 7/1994 | Busch | |
| 5,369,810 | A | | 12/1994 | Warren | |
| 5,369,813 | A | | 12/1994 | Goddard et al. | |
| 5,394,569 | A | * | 3/1995 | Poirier et al. | 4/213 |
| 5,519,899 | A | | 5/1996 | Taylor | |
| 5,875,497 | A | | 3/1999 | Lovejoy | |
| 6,158,058 | A | | 12/2000 | Martens | |
| 6,295,656 | B1 | | 10/2001 | Tillen | |
| 6,370,702 | B1 | | 4/2002 | Iddings, Sr. | |
| 6,370,703 | B1 | * | 4/2002 | Kim et al. | 4/216 |
| 6,643,850 | B2 | | 11/2003 | Chasen et al. | |
| 6,694,534 | B2 | | 2/2004 | Stone | |
| 6,983,491 | B2 | * | 1/2006 | Curtis et al. | 4/216 |
| 2005/0081285 | A1 | * | 4/2005 | Mundt | 4/349 |

FOREIGN PATENT DOCUMENTS

| | | | |
|---|---|---|---|
| GB | 2209356 A | * | 5/1989 |
| GB | 2384495 A | * | 7/2003 |

* cited by examiner

*Primary Examiner*—Gregory L. Huson
*Assistant Examiner*—Kristie A. Mahone
(74) *Attorney, Agent, or Firm*—Bryan Hoerbelt; Smith & Hopen

(57) ABSTRACT

A ventilation system for a toilet which functions by drawing air from around the bowl through the original flush holes into the existing overflow-pipe and then into a fan compartment. The fan is activated by manipulating the flush handle upward. Malodorous air is then forced through an exhaust pipe into the sewage line downstream of the gas trap. The fan is deactivated when the flush handle is pressed downward and the toilet is flushed. A water-trap between the fan and the toilet tank prevents the malodorous air from escaping into the tank. The water in the water trap is changed with each flush by redirecting the refill tube into the water trap. This prevents the water in the water trap from becoming stagnant.

7 Claims, 3 Drawing Sheets

TOILET EVACUATION SYSTEM

CROSS REFERENCE TO RELATED APPLICATION

This application claims priority to U.S. Provisional Patent Application No. 60/481,477 having the same title and filed by the same inventor on Oct. 7, 2003.

BACKGROUND OF THE INVENTION

Several methods have been employed to address the issue of foul odors emanating from a toilet. Previous attempts to address this issue have involved drawing the air from the bowl into the tank for treatment and disposal. Although much of the prior art relies on similar theories of design, the individual applications vary.

For example, U.S. Pat. No. 4,864,664 to Higgins describes a ventilated toilet having an air duct and water trap system for removing air contaminated with objectionable odors directly to a sewer line. The toilet bowl and tank have built-in air systems and the toilet seat is hollow and forms part of the air system. The fan and electrical components are located at the highest level of the fan-duct system so that water entering the air system due to tank overflow or a leak in the system will run out through the duct system before reaching the electrical components. The present system provides a water trap/air vent combination which does not rely on running water to refill the trap.

The '664 patent differs from the present invention in two significant respects however. First, air travels from the bowl to the tank through holes in the hollow seat, rather than using the pre-existing flush holes under the rim of the bowl. Secondly, the connection through which air travels to the sewer line is incorporated into the tank. This would make retrofitting unduly burdensome. It also creates a possibility of gases traveling from the sewer line into the tank.

Similarly, U.S. Pat. No. 4,103,370 to Arnold describes a toilet system with an intake manifold interposed between the seat and the top periphery of the bowl. A fan is arranged to draw air from the manifold and deliver it to the sewer connection beyond the water trap. The manner in which air passes from the bowl, through the intake manifold to the tank, is a significant departure from existing toilet design, making retro-fit impracticable.

Therefore, what is needed is an efficacious system of adapting a toilet to draw malodorous air from the area surrounding the bowl and disposing said air into the septic line. To be truly efficacious, the system would need to be inexpensive in its creation, as well as allow for the retrofitting of existing toilets.

SUMMARY OF THE INVENTION

The inventive apparatus includes a ventilation system for a toilet, generally comprising a toilet bowl having a gas trap and a rim, a plurality of flush holes formed in said rim; a toilet tank having a flush handle, a water refill tube, an overflow pipe in fluid communication with the flush holes and an exhaust pipe providing fluid communication between the toilet tank and the gas trap; a fan box disposed within the toilet tank; an air compartment disposed within the fan box in fluid communication with the toilet overflow pipe such that air follows a path of travel through the flush holes and through the overflow pipe into the air compartment; a water trap disposed within the fan box adjacent the air compartment with a first side of the water trap in fluid communication with water in the holding tank and a second side in fluid communication with the air compartment such that water, at normal operating levels in the tank, enters the water trap to provide a seal between the air compartment and that part of the holding tank not containing water; a fan compartment having an inlet and an outlet disposed within the fan box, adjacent the air compartment with the inlet in fluid communication with the water compartment and the outlet in fluid communication with the exhaust pipe; a fan disposed within the fan compartment such that when the fan is activated, air is drawn through the flush holes up through the overflow pipe into the water compartment, through the fan compartment and into the exhaust pipe; and an activation switch communicatively coupled to the fan whereby manipulation of the activation switch completes an electrical circuit thereby activating the fan which draws air from the bowl through the flush holes and overflow pipe into the air compartment, into the fan compartment and through the exhaust pipe into the toilet drain downstream of the gas trap.

In alternative embodiments, the ventilation system further comprises the air compartment being equipped with an air flap operative to prevent gas in the fan compartment from entering the air compartment. The activation switch can be communicatively coupled to the flush handle so that manipulation of the handle in an upward direction completes an electrical circuit activating the fan and the flush handle, when depressed, interrupts the electrical circuit to deactivate the fan. The water refill tube adapted to empty into the water trap so that when the water trap is full, refill water flows into the toilet bowl as well as the water tank, therefore, the water in the water tank being changed during every flush to inhibit water stagnation and bacterial growth.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Figure 1:
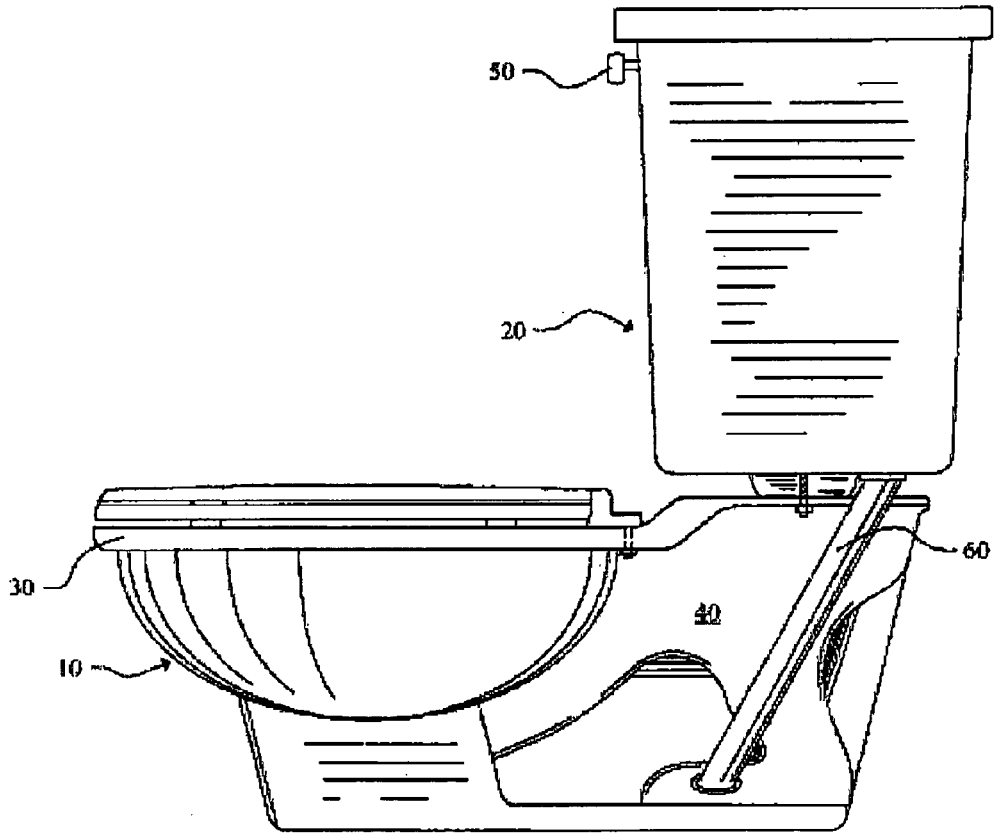
FIG. 1 is a side-perspective view of the inventive apparatus.

Referring now to FIG. 1, the inventive ventilation system is designed for use with common toilets. Toilet bowl 10 includes rim 30, gas trap 40 leading to a sewer line (not depicted), and toilet tank 20 having flush handle 50 and exhaust pipe 60. Exhaust pipe 60 extends from toilet tank 20 to the sewer line downstream of gas trap 40.

Figure 2:
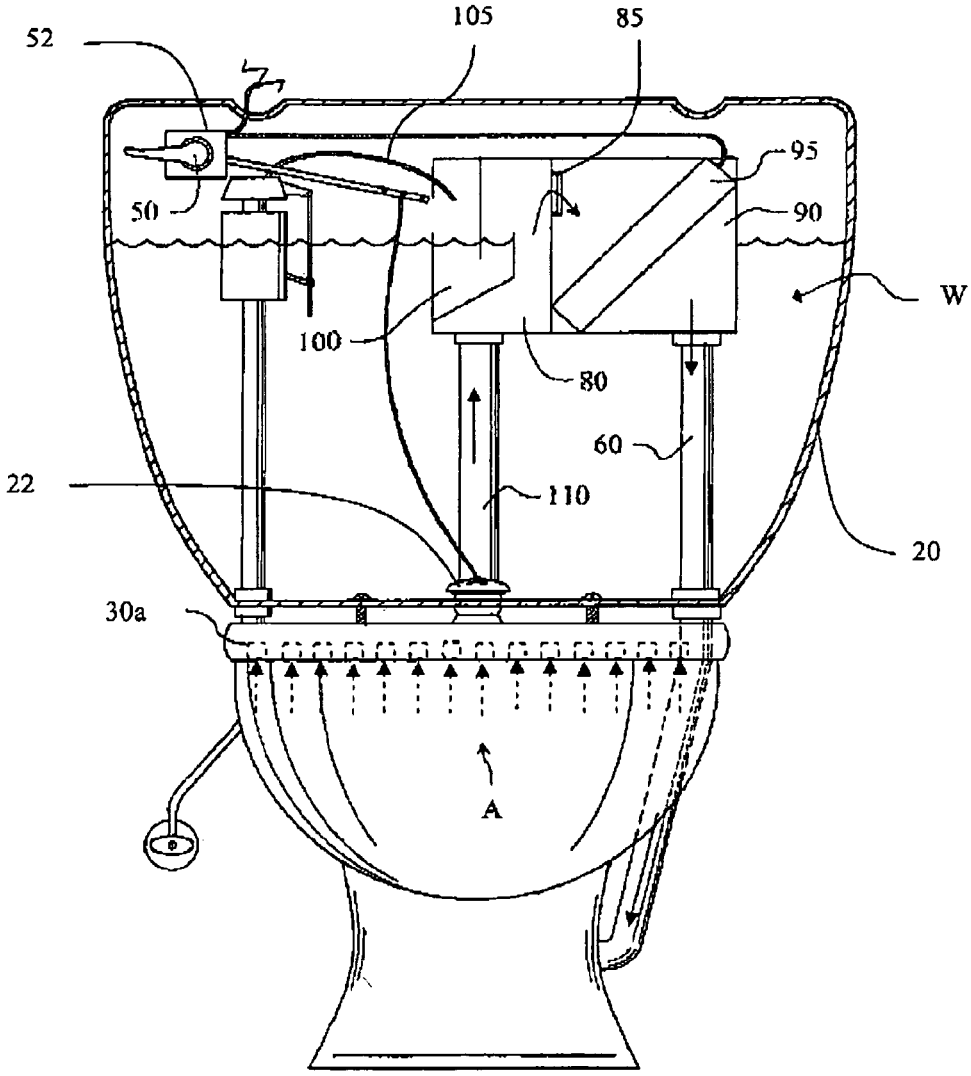
FIG. 2 is an illustrative view of one embodiment of the inventive apparatus wherein the fan comprises both an air compartment and fan compartment.

Fan box 70 is disposed within tank 20. As depicted in FIG. 2, fan box 70 includes air compartment 80 and adjacent fan compartment 90. Fan box 70 surmounts overflow pipe 110 which is connected to the flush holes (30*a*) located under the rim of the toilet bowl, as with most toilets. This configuration allows the air compartment to remain in fluid communication with the interior of the bowl during normal operation. As its name suggests, fan compartment 90 is equipped with a small electric fan 95. The fan is powered by a low voltage current which can be converted from 110-volt a.c. G.F.I.C. through a converter. All components are constructed from water proof materials to ensure safety in the event that the fan box, containing the electric fan, is filled with water. Alternatively, it is anticipated that the fan box be constructed in a watertight fashion.

Air is drawn through the flush holes into overflow pipe 110 when the fan is activated. The air then passes through air compartment 80 into fan compartment 90. The fan then forces the air through exhaust pipe 60 into the sewer line downstream of the gas trap (not shown). The flow of air through the system is by arrows (A) shown in FIG. 2. In one embodiment the fan is activated by a switch located on the flush handle 50. In this embodiment, lifting the flush handle upward engages the switch (52) in a hold position, completing an electrical circuit (54, FIG. 3) thus providing power to the fan. When toilet handle 50 is depressed, thereby flushing the toilet, the electrical circuit is interrupted and power to the fan is cut-off.

In another embodiment, air compartment 80 is separated from fan compartment 90 by air flap 85 which is hingedly connected to fan compartment inlet 70*a* and prevents air from traveling from the fan compartment into the air compartment but allows air to travel in the reverse direction. Alternatively, air flap 85 can be attached to fan compartment outlet 70*b*. This provides additional protection since it is possible that air from the sewer line, downstream of the gas trap, could enter the fan compartment through exhaust pipe 60.

In another embodiment, the air compartment is equipped with a water trap 100. The water trap forms a seal between that portion of the tank not filled with water during normal operation and the air compartment. The seal formed by the water trap concentrates vacuum pressure (created by the fan) to draw malodorous air from the bowl rather than air from inside the toilet tank. The trap also allows water to escape from the tank into the overflow pipe in cases where water inside the tank exceeds normal operating levels. This allows the overflow pipe to perform its conventional function.

Figure 3:
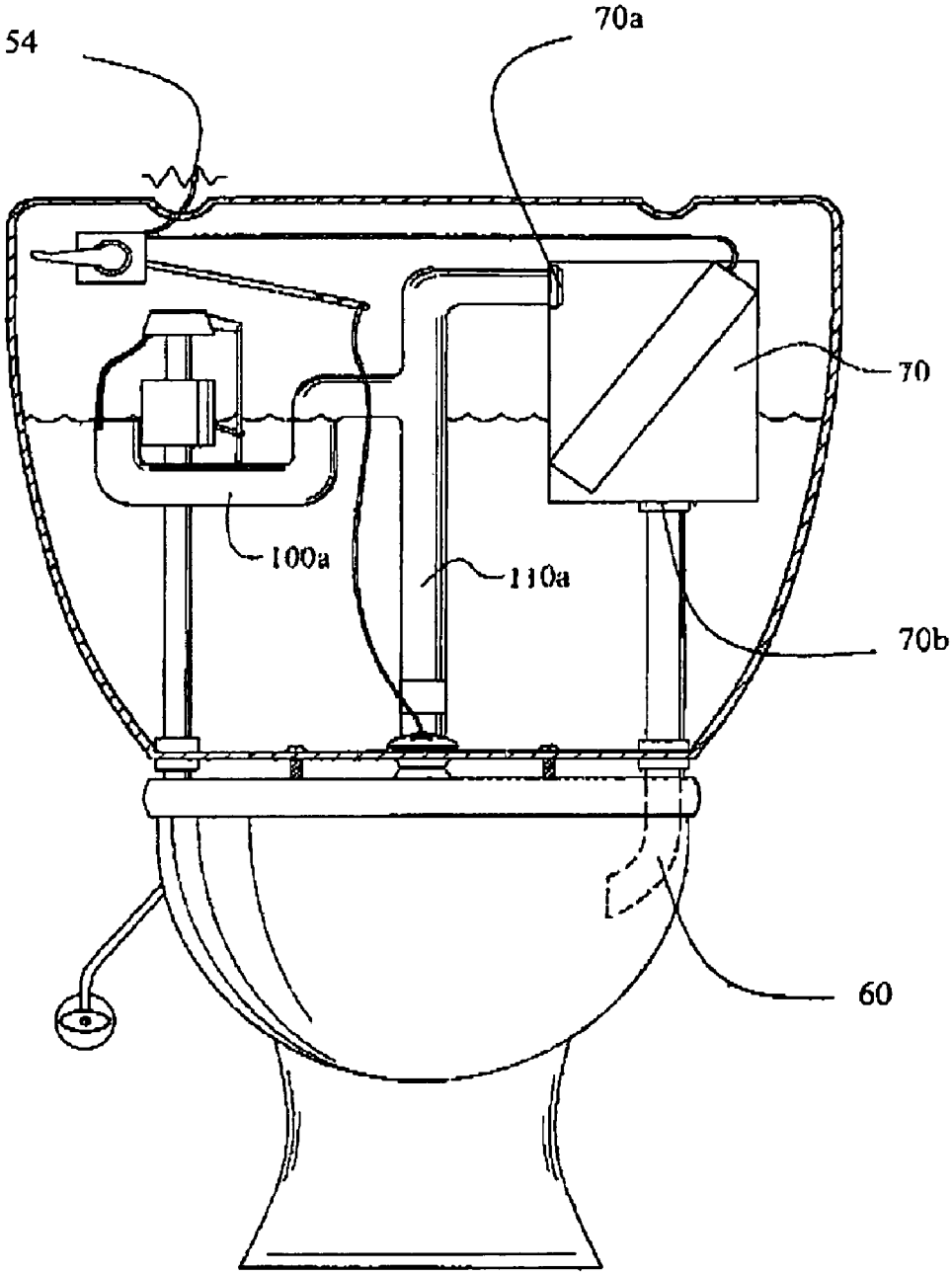
FIG. 3 is an illustrative view of an alternate embodiment of the inventive apparatus wherein the overflow pipe is adapted to allow fluid communication between the fan box while allowing the overflow pipe to fulfill its original function.

In another embodiment, the air compartment is not equipped with a water trap. To prevent the tank from overflowing, the overflow pipe is equipped with a second "branch" which extends into the tank to serve as an overflow pipe (FIG. 3). In this embodiment, the fan box consists only of the fan compartment 70, as the need to facilitate overflow control is addressed by the adapted water trap 100(*a*). In the event the tank becomes filled with water above normal operating levels, water enters water trap 100(*a*) and then flows through the original overflow pipe 110(*a*) into the bowl, as with normal toilets. As with the first embodiment, the refill tube (105) can empty directly into the water trap as long as the overflow-pipe-side of the water trap is above normal operating levels (W, FIG. 2).

In another embodiment, the traditional flapper (22, FIG. 2) is equipped with an overflow pipe which allows it to perform a dual function. This configuration obviates the need for a water trap to be located in the fan box.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be the to fall therebetween. Now that the invention has been described,

What is claimed is:

1. A ventilation system for a toilet, comprising;

a toilet bowl having a gas trap and a rim a plurality of flush holes formed in said rim;

a tank having a flush handle, a water refill tube, an overflow pipe in fluid communication with the flush holes and an exhaust pipe providing fluid communication between the tank and the gas trap;

a water tight fan box disposed within the tank;

an air compartment disposed within the fan box in fluid communication with the toilet overflow pipe such that air follows a path of travel through the flush holes and through the overflow pipe into the air compartment;

an upwardly facing water trap disposed within the fan box adjacent the air compartment with a first side of the water trap in fluid communication with water in the tank and a second side in fluid communication with the air compartment such that water, at normal operating levels in the tank, enters the water trap to provide a seal between the air compartment and that part of the tank not containing water, whereby the seal between the air compartment and that part of the tank not containing water is maintained when water is expelled from the tank;

a fan compartment having an inlet and an outlet disposed within the fan box, adjacent the air compartment with the inlet in fluid communication with the air compartment and the outlet in fluid communication with the exhaust pipe;

a fan disposed within the fan compartment such that when the fan is activated, air is drawn through the flush holes up through the overflow pipe into the air compartment, through the fan compartment and into the exhaust pipe; and an activation switch communicatively coupled to the fan whereby manipulation of the activation switch completes an electrical circuit thereby activating the fan which draws air from the bowl through the flush holes and overflow pipe into the air compartment, into the fan compartment and through the exhaust pipe into the toilet drain downstream of the gas trap.

2. The ventilation system of claim 1, further comprising:

the air compartment being equipped with an air flap said air flap operative to prevent gas in the fan compartment from entering the air compartment.

3. The ventilation system of claim 1, further comprising:

the activation switch being communicatively coupled to the flush handle so that manipulation of the handle in an upward direction completes an electrical circuit activating the fan.

4. The ventilation system of claim 3, further comprising:

the flush handle, when depressed, being adapted to interrupt the electrical circuit to deactivate the fan.

5. The ventilation system of claim 1, further comprising:

the water refill tube adapted to empty into the water trap so that when the water trap is full flows into the water tank;

the in the water tank being changed during every flush to inhibit water stagnation and bacterial growth.

6. A ventilation system for a toilet, comprising;

a toilet bowl having a gas trap and a rim a plurality of flush holes formed in said rim;

a tank having a flush handle, a water refill tube, an overflow pipe in fluid communication with the flush holes and an exhaust pipe providing fluid communication between the tank and the gas trap;

a water tight fan box disposed within the tank;

an air compartment disposed within the fan box in fluid communication with the toilet overflow pipe such that air follows a path of travel through the flush holes and through the overflow pipe into the air compartment;

an upwardly facing water trap disposed within the fan box adjacent the air compartment with a first side of the water trap in fluid communication with water in the tank and a second side in fluid communication with the air compartment such that water, at normal operating levels in the tank, enters the water trap to provide a seal between the air compartment and that part of the tank not containing water, whereby the seal between the air compartment and that part of the tank not containing water is maintained when water is expelled from the tank;

a fan compartment having an inlet and an outlet disposed within the fan box, adjacent the air compartment with the inlet in fluid communication with the air compartment and the outlet in fluid communication with the exhaust pipe;

a fan disposed within the fan compartment such that when the fan is activated, air is drawn through the flush holes up through the overflow pipe into the air compartment, through the fan compartment and into the exhaust pipe; and an activation switch communicatively coupled to the fan whereby manipulation of the activation switch completes an electrical circuit thereby activating the fan which draws air from the bowl through the flush holes and overflow pipe into the air compartment, into the fan compartment and through the exhaust pipe into the toilet drain downstream of the gas trap;

wherein the activation switch is communicatively coupled to the flush handle so that manipulation of the handle in an upward direction completes an electrical circuit activating the fan.

7. The ventilation system of claim 6 wherein the flush handle is adapted to interrupt the electrical circuit to deactivate the fan.

* * * * *